US005154671A

United States Patent [19]

Smollar et al.

[11] Patent Number: 5,154,671

[45] Date of Patent: Oct. 13, 1992

[54] WATER SLIDE AND POOL WITH WATER CURTAIN AND POOL REPLENISHMENT SYSTEM

[75] Inventors: Marvin Smollar, Northbrook; Richard B. Mazursky, Glenview, both of Ill.

[73] Assignee: Marchon, Inc., Arlington Heights, Ill.

[21] Appl. No.: 718,191

[22] Filed: Jun. 20, 1991

Related U.S. Application Data

[63] Continuation-in-part of Ser. No. 212,897, Jun. 29, 1988.

[51] Int. Cl.[5] ..... A63G 21/00

[52] U.S. Cl. ..... 472/117

[58] Field of Search ..... 472/117, 116, 88, 128

[56] References Cited

U.S. PATENT DOCUMENTS

| | | | |
|---|---|---|---|
| 2,446,905 | 8/1945 | Buffum | 472/117 |
| 3,246,892 | 4/1966 | Grudoski | 472/117 |
| 3,539,181 | 11/1970 | Larsen | 472/117 |
| 4,805,898 | 2/1989 | Jacober et al. | 472/117 |

*Primary Examiner*—Richard E. Chilcot, Jr.
*Attorney, Agent, or Firm*—Lafe, Whitesel, Conte & Saret

[57] ABSTRACT

A backyard type of water slide has an elongated strip of plastic terminating in a pool. A pipe in the form of a hoop is arched over approximately the center of said pool. A plurality of holes are formed in the pipe in order to focus a plurality of streams of water at two locations in the pool. Preferably the focus is on two locations are fore and aft of the hoop.

13 Claims, 3 Drawing Sheets

WATER SLIDE AND POOL WITH WATER CURTAIN AND POOL REPLENISHMENT SYSTEM

This is a continuation-in-part of Ser. No. 07/212,897, filed Jun. 29, 1988.

This invention relates to water slides made of a flexible material that is placed on the ground and that becomes lubricous when covered with a thin layer of water, and more particularly, to toys or similar water slides on which persons, primarily children, may slide as a matter of a backyard type of recreation.

Existing toys use long flexible plastic material laid on the ground and covered with a thin layer of water in order to decrease friction and to enable people to slide across the material. This type of toy requires a more or less constant supply of water onto the upper surface of the material. Relevant considerations of the toy and recreational industry also include providing a safe product, a means for attaching the sheet firmly to the ground, and a constant layer of water on the sheet. An example of such a toy is found in my earlier filed application Ser. No. 07/212,897.

Various commercial products having a slide are sold under the trademarks "CROCODILE MILE®", a slide manufactured by Marchon, Inc.; "WET BANANA" (TM), a slide manufactured by Koki, Inc.; "WHITE WATER RAPIDS", a slide by Kransco; and "WHAM-O SLIP 'N SLIDE". Each of these slides may include a plastic sheet, means for attaching the sheet to the ground, and a near-by sprinkler that may be formed by a perforated tube or other device positioned along or near at least one of the edges of the sheet. A garden hose is connected to the sprinkler in order to continuously supply a layer of water onto the top of the slide material.

These slides may end in a pool of water into which the sliding person may "splash down". The pool gives both an aspect of interest to the toy and a shock absorbing device which absorbs energy and stops the sliding body. One side effect is that the water is splashed out of the pool and should be replenished continuously for the user to achieve the maximum benefit of the pool. Here, the problem is to keep replenishing water in the pool within the context of the toy. For example, in the toy sold under the trademark "CROCODILE MILE", the spray on the slide comes from a plastic part which has an appearance suggesting the head of a crocodile. To preserve an illusion in keeping with the motif of the toy, the water for the pool should come from something having a similar and compatible appearance. However, since childrens' interests change with the times, it should also be possible to change the motif at the lowest possible cost. For example, tomorrow the child might want to try a space toy. Some backyard pools have ways of placing "water rapids" ahead of the pool. However, this arrangement does assure the replenishment of water in the pool itself. Thus, the user may splash the water out of the pool.

Another consideration is the sensation that the child feels as he slides along the strip and into the pool. When the water is equally directed along the length of the slide and into the pool, the child may feel as if he is in the rain, but he does not have any sensation of specifically encountering a focused surge of water. On the other hand, if he slides into a curtain of water focused specifically on him, he has a sensation of having encounter a unique adventuresome episode.

Accordingly, an object of this invention is to provide new and improved water toys. Here, an object is to provide a source of water in the context of a toy for replenishing the pool at the end of a slide. In particular, an object of the invention is to concentrate a water supply delivery system to continuously direct a stream of water into the pool in order to maintain its level.

Another object is to provide a new and novel toy with a new center of attraction for the user. In this connection, an object is to provide a focused spray of water for the child to encounter as an adventuresome episode In keeping with an aspect of the invention, a water spray from a pipe in the form of a hoop is placed directly over the pool to insure that all of the water, even that dripping off the hoop, reaches the pool. The water issuing from the hoop is delivered in the form of many streams focused directly into the pool and onto the sliding child. While the focus of the water may be any place within the pool, a preferred embodiment focuses the water at one or more points where the person using the slide would find it most pleasing.

A preferred embodiment of the invention is shown in the attached drawings wherein.

Figure 11:
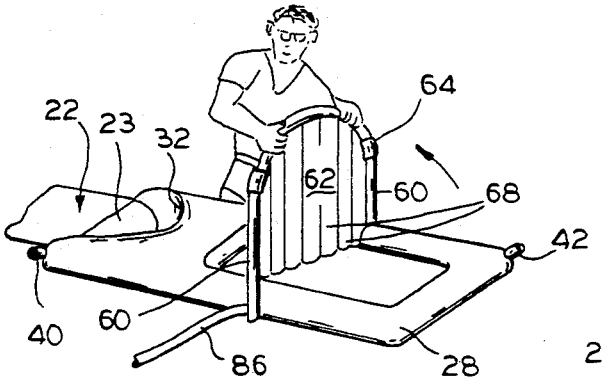
FIG. 11 is a partial perspective view showing the manner of emplacing the arch and curtain-like means in a desired position relative to the pool.
Figure 12:
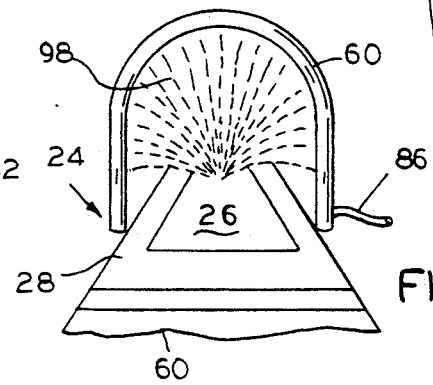
Figure 13:
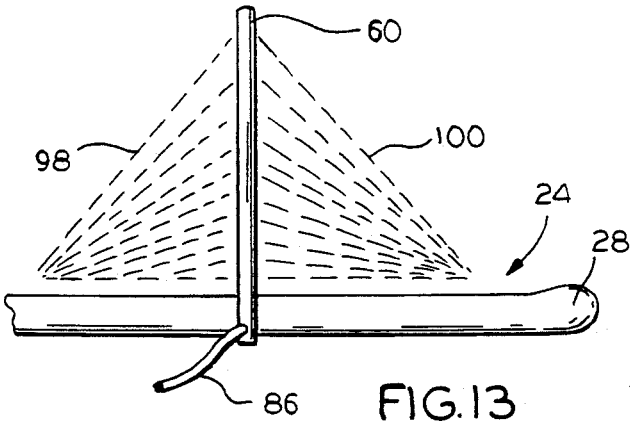
Figure 14:
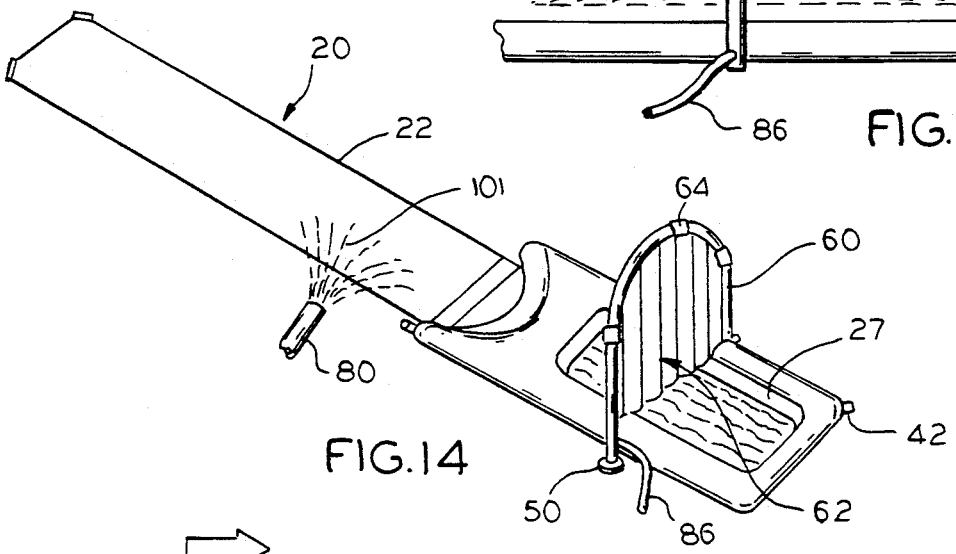
Figure 15:
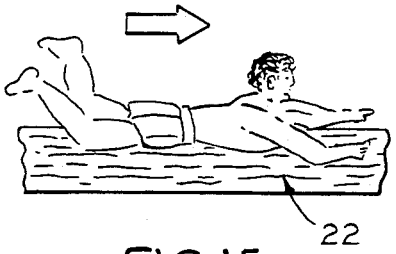
Figure 16:
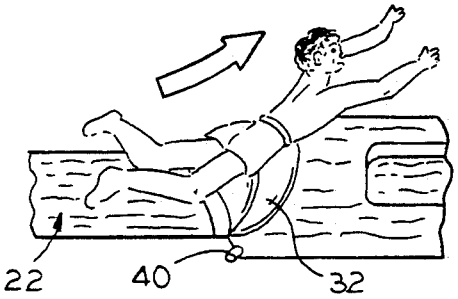
Figure 17:
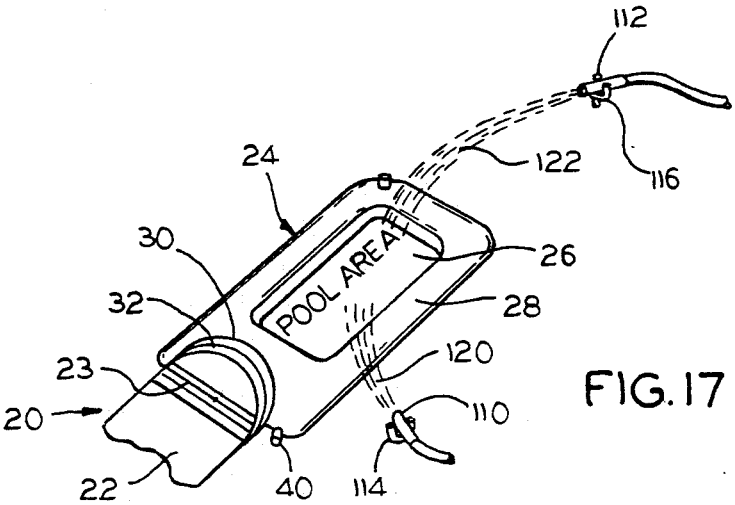

FIG. 12 discloses, in a front elevation view, the assembly of a U-shaped pipe or hoop member with water issuing therefrom;

FIG. 13 is a side view of the hoop member of FIG. 11 showing the focus of water issuing therefrom;

FIG. 14 is a perspective view of a preferred embodiment of the invention in an assembled condition, with the pool filled with water, and with a sprinkler head inundating the slide with a constant fan-shaped supply of water for creating a lubricous condition on the sliding surface and for filling the pool as may be necessary for a proper usage thereof;

FIGS. 15 and 16 show a side elevational view of a person sliding down the slide portion; and FIG. 17 shows a second embodiment of a way of replenishing pool water and giving a child an adventuresome episode.

Figure 1:
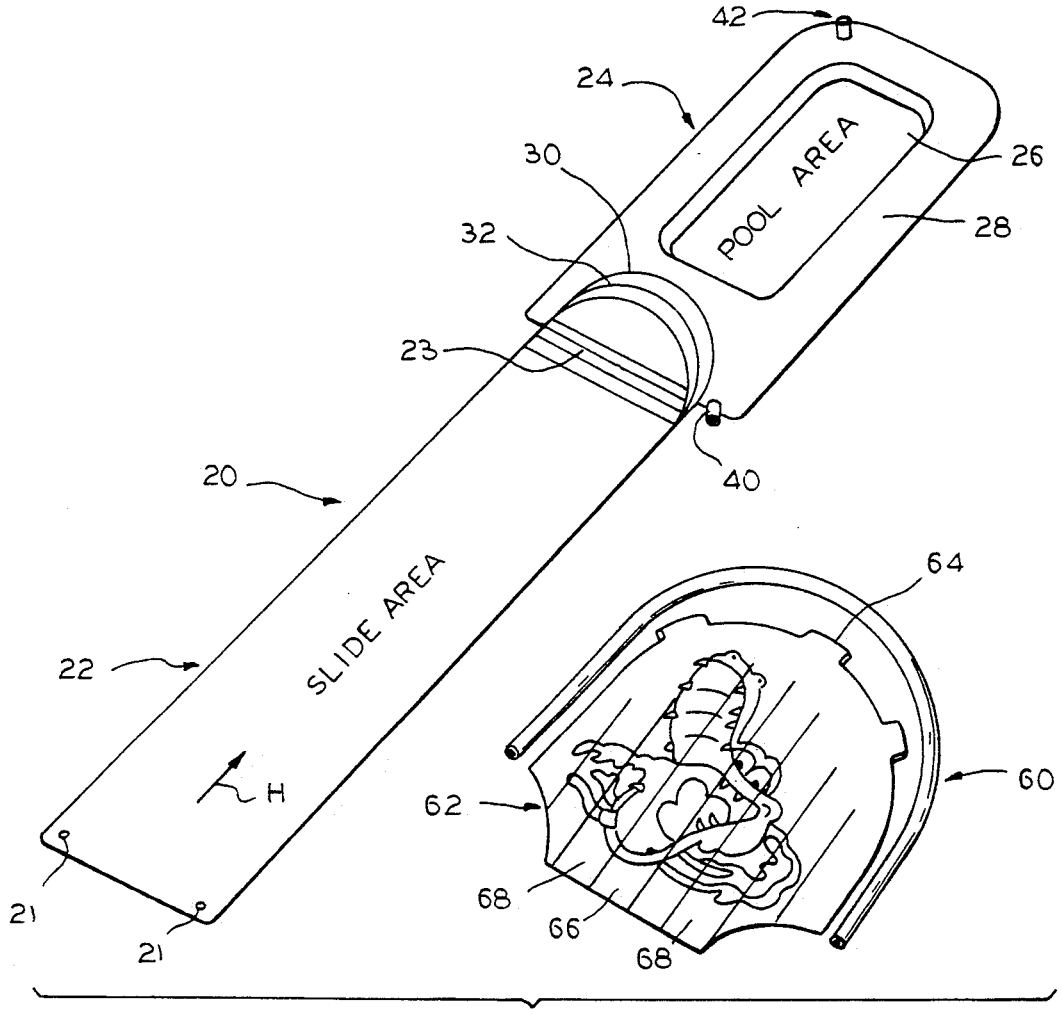
FIG. 1 is a perspective view of the slide, pool, hoop, and curtain components making up the invention.

Preferably, the water slide toy 20 (FIG. 1) is an all plastic member which is integral with a pool and which includes an elongated generally lubricous slide portion 22 connected via a ramp/bump portion 23 to a pool portion 24. Slide 22 is staked to the surface of the earth.

The pool portion 24 includes a generally planar base element 26. Surrounding and forming the perimeter wall for the pool base 26 is a toroidal, hollow wall 28 enclosing base 26. A broader transverse portion 30 extends between the two longer arms of wall 28. One side of the transverse portion 30 is adjacent a smaller ramping section 32 facing the slide portion 22. The ramp or slanted wall 32 blends into the transverse portion 30 to give a ramp/bump. The ramping wall 32 is curved to give a sloped, generally semi-circular concave configuration facing the slide 22 in order to guide and direct anyone who may be sliding into the pool.

Figure 2:
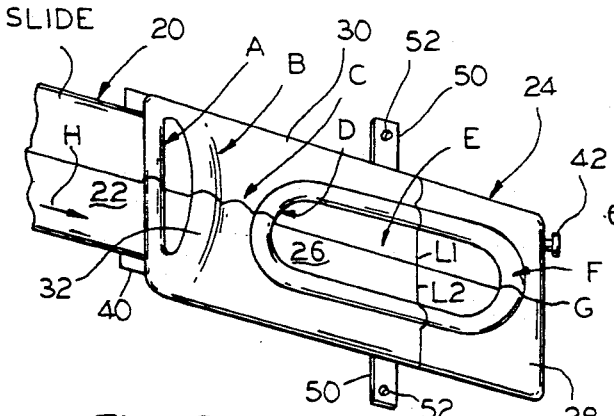
FIG. 2 is a partial perspective view of the pool end of the toy, with at least one ramp/bump, and a pool element, showing its disposition on the ground, the pool overlying an optional hoop retaining strap which projects outwardly from opposite sides thereof.

A child, for example, who uses the slide is confronted by the ramp/bump 23 which propels him upwardly into the air and then into a shallow splash down pool 24. More particularly, a plurality of bumps "A" through "C" (FIG. 2) are of graduated height progressively forming a ramp 23. The various bumps also add additional areas to act as a shock absorber and to absorb energy from the sliding person. The tubular members forming these bumps are made by sealing together plastic sheets forming base 26.

At opposite ends of the pool portion 24 are inlet/outlet tubes 40 and 42, which have several functions. First, it is desirable to have two tubes, as opposed to a single tube, in order to facilitate emptying. This is especially important since emptying the water could prove to be very cumbersome if there is only one opening and the slide is on an incline with the one opening on the high side of the incline.

The water slide is deployed by being unrolled and staked onto a cleaned, pre-wetted, and preferably grassy area. The inlet and outlet tubes 40, 42 generally communicate with the interior of the pool wall. Except while open for filling or emptying the pool walls, these tubes 40, 42 are sealed by any suitable clamping means.

Figure 3:
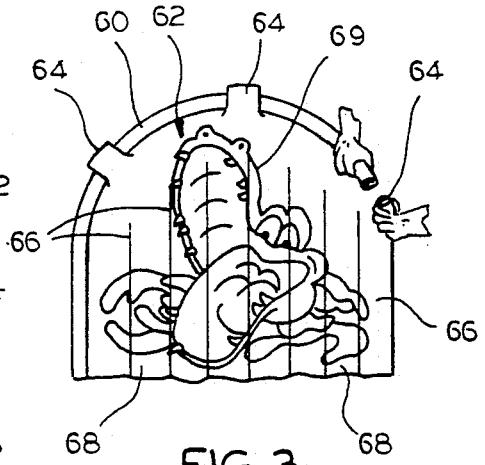
FIG. 3 is a partial detail showing of an assembly having a curtain-like shower means with its supporting pipe in the form of a hoop shaped arch means.

FIG. 3 shows a hollow pipe, curved to form a U-shaped hoop or arch 60 for supporting a curtain-like member 62, as by threading hoop 60 through a plurality of spaced loops 64 attached to the hoop 60 or by wrapping straps around member 60. The hoop 60 is a hollow pipe or tube which has holes distributed along its length in order to issue a spray or shower of water. The curtain-like member 62 is slit along spaced parallel lines 66 to provide a plurality of flexible flaps 68, preferably having indicia 69 imprinted thereon for give a child a sense of added adventure. In the example shown in the drawing, the indicia is a crocodile. The motif could be changed completely by changing the indicia 69 and any other related theme element.

Figure 4:
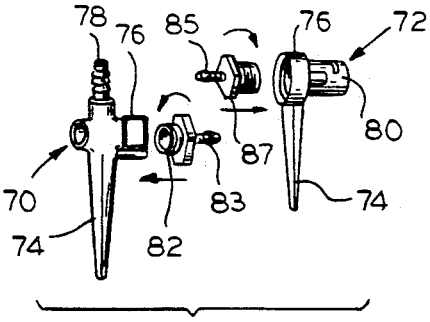
FIG. 4 shows the hardware that is used to install the hoop of curtain-like shower means of FIG. 3.
Figure 7:
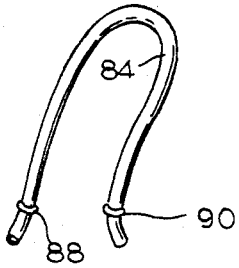
Figure 8:
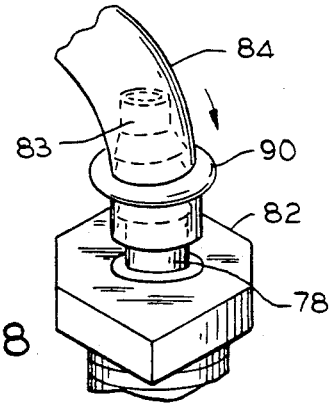
Figure 10:
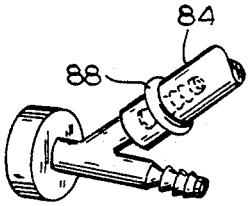
FIGS. 9 and 10 are an exploded view and a clamped end view which show how to install the water delivery system.
Figure 9:
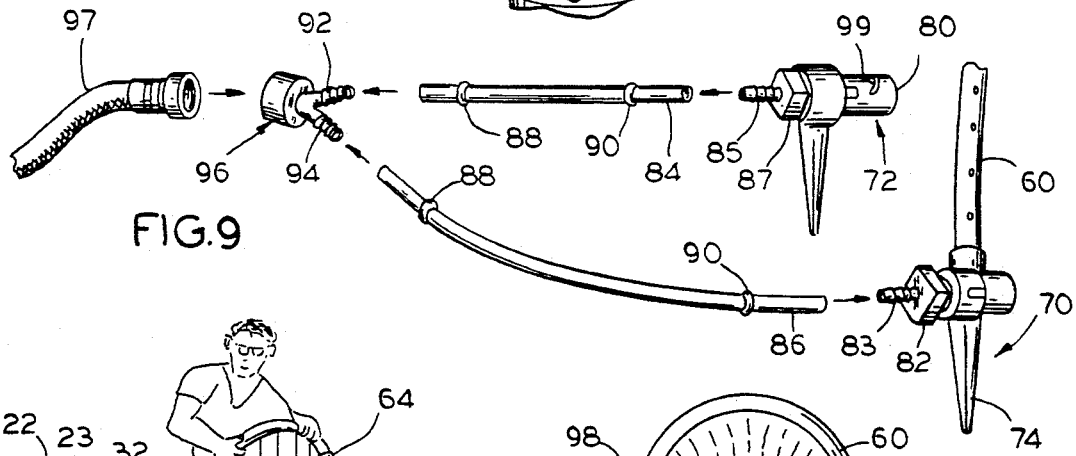

The hardware for mounting hoop 60 is shown in FIG. 4 and the steps followed to for installing the hoop member 60 and to set up the inventive fountain are shown in FIGS. 5–11. In greater detail the hardware includes two members 70, 72 (FIG. 5) each of which has a stake 74 on the bottom, a thread coupler 76, and an outlet 78, 80 in communication with the coupler 76. The outlet 78 supplies water to the hoop 60 and outlet 80 sprays the slide 22. A threaded end coupler 82 is fitted into each of the sockets 76 on the members 70 or 72 for receiving water. Member 82 may be either the threaded coupler on the end of a garden hose or an adapter having a barbed insert 83, 85 to receive a special hose (FIG. 9). In this particular case, an adapter is used.

Figure 5:
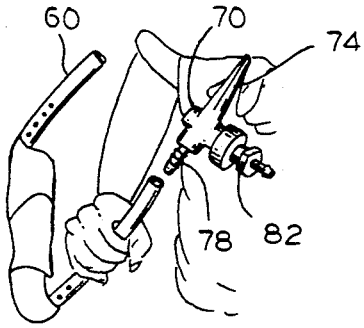
FIGS. 5–8 are four stop motion views showing the steps followed to install the curtain-like shower means.
Figure 6:
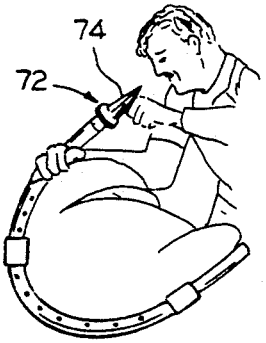

On the stake member 70, the barbed end 78 fits into the end of the pipe forming hoop member 60 (FIG. 5). Another stake member 70 is placed in the other end of the hoop 60 (FIG. 6) and the socket 76 in such other stake is plugged with a solid member. Alternatively, the other stake may be simply a solid member since it is not part of any water delivery system. The choice between a water delivery stake and a solid stake is based upon the cost and convenience of two different or one type of piece part.

Next, O-rings 88, 90 are placed over the ends of each of the tubes 84, 86, as shown in FIG. 7. One end of each of the tubes 84, 86 is slipped onto the barbed ends 85, 83 (respectively) of the adapters 82, 87. Then, the O-rings 90 are rolled down over the hose at the barbed ends (FIG. 8). The opposite ends of the hoses 84, 86 are fitted (FIG. 10) over barbed ends 92, 94 of a "Y" adapter 96 that fits onto a garden hose 97. Then, the two stake ends 74 of the hoop 60 are ready to be placed in the earth. The member 72 is staked near the slide 22 (FIG. 14) so that water issues from slot 99 and member 80 showers slide 22 and makes it lubricous.

Means are provided for giving the child an adventuresome episode as he encounters the pool. More particularly, when the water is turned on, the holes in the pipe forming hoop 60 deliver twin sprays or sheets 98, 100 (FIGS. 12, 13) .of water focused toward both ends of the pool 24. As best seen in FIG. 13, the child hits two "walls of water" as he enters the pool and comes to rest at the end of the pool. Since the hoop 60 is directly over the pool, even water dripping from the hoop 60 and the curtain 62 is deposited into the pool. Hence, although the child "splashes down" into the pool, there is plenty of replenishing water to keep the pool full.

FIG. 17 shows a second embodiment for giving the child an adventuresome episode. Here two nozzles 110 and 112 are staked into the earth at 114 and 116 and directed toward the pool. Thus, the child sliding into the pool first encounters a spray 120 and then a spray 122.

The assembly described above takes place prior to filling the pool walls 28. When the walls 28 are filled, they preferably expand outwardly and embrace the ends of arch member 60 with a clamping-like action. In addition, the weight of the pool walls 28 exert a downward and anchoring pressure. This design is important because it holds the hoop 60 and curtain 62 in a proper vertical orientation, while being sufficiently flexible and yielding to avoid injuries if a sliding person impacts them. The soft side walls 28 also act as a cushion to prevent the user from impacting hard plastic parts.

Preferably, means are provided for filling the pool walls and the ramp/bump with water. However, it should be understood that other fluids may also be used. For example, the pool walls may be inflated with air.

The weight of the water within the walls 28 insures a proper positioning of the pool 24 during its use. The slide 22 is manually pulled taut, extending longitudinally from its juncture with the base portion 26 of the pool 24. After the slide 22 is taut, suitable stakes are used to secure it in place. The pool cavity 27 is filled with water 90. The slide 22 is covered with a film of water sprayed from sprinkler member 80 to make it more lubricous. The sprinkler 80 (FIG. 14) may be fixed to the earth a safe distance (approximately 3 feet) from the slide 22. The sprinkler has a nozzle 99 (FIG. 9) which provides a wide fan-shaped cascade of water 101 for maintaining a film of water on the slide 22. Other lubricous materials, such as soap or silicone, can also be used.

In use, a person runs toward the slide 22 and belly-flops on it, as seen in FIG. 15. Upon impacting the angled ramp/bump wall 32 (FIG. 16), the body of the sliding person is angled upwardly by bumps A–D (FIG. 12). The momentum raises him over the bumps which further increases the body's upward angle where he encounters the first wall of water spray at 98 (FIG. 13). On the last bump, the body is catapulted upwardly and forwardly so that the sliding person's arms and body move through the flaps 68 of the curtain means 62. Then, he drops into the water in the pool cavity 27 where he is sprayed by the second wall of water spray 100. The person's forward motion is slowed by the water and bumps F and G at the far side of the pool.

If the sliding body does not have sufficient momentum to carry it into the pool, the soft, water or air filled bumps act as a shock absorber.

The slide portion 22, pool and other parts are preferably fabricated from a linear low density virgin polyethylene with slip additives. The pool portion is also made of a polyethylene material, preferably with elastomeric blends for added strength. While other materials, such as vinyl, may be substituted. The hardware 70, 72 may be injection molded from any suitable plastic material that has the necessary strength and rigidity.

Those who are skilled in the art will readily perceive how to modify the invention. Therefore, the appended claims are to be construed to cover all equivalent structures which fall within the true scope and spirit of the invention.

The invention claimed is:

1. A toy comprising an elongated slide adapted to be staked down on a supporting surface and wetted with water, a pool at the end of the slide for receiving and stopping the forward motion of a person sliding along the elongated slide, a fountain member at a location which deposits said water in said pool by focusing the water on a position through which a person passes as he moves from the slide and into the pool, and means associated with said fountain member for supplying and replenishing water in at least one adventuresome episode to said pool.

2. The toy of claim 1 wherein said fountain comprises a pipe in the form of an arch or hoop suspended above said pool, and said means for supplying an adventuresome episode comprises holes in said pipe for issuing streams of water focused upon a location in said pool.

3. The toy of claim 1 wherein said fountain is a pipe in the form of a hoop suspended over said pool, and said means for supplying an adventuresome episode comprises a plurality of holes formed in said pipe to issue streams of water which are focused upon two locations in said pool, said locations being fore and aft of said hoop.

4. The toy of claim 3 and a curtain of vertical strips hanging from said hoop for a person sliding on said slide to pass through.

5. The toy of claim 4 and means at a junction between said slide and said pool for catapulting the body of a sliding person under said hoop and through said vertical strips into said pool.

6. The toy of claim 1 wherein said fountain comprises at least one nozzle focused upon a place in said pool, and said means for supplying an adventuresome episode comprises directing a spray from said nozzle to strike a person as he slides into said pool.

7. The toy of claim 6 wherein there are two of said nozzles directed to strike the person in two separate locations.

8. The toy of claim 2 and stake means having an inlet port in communication with an outlet port, said outlet port fitting into and supporting said pipe, and means for supplying water through said inlet port and out said outlet port in order to supply said streams of water focused upon said locations.

9. A backyard type of waterslide comprising an elongated strip of plastic having a surface which becomes lubricous when wet, a spray head positioned to maintain a layer of water on the surface of said strip of plastic, a pool attached to and part of said slide for receiving and stopping the body of a person sliding along said elongated strip of plastic, a pipe in the form of a hoop suspended over said pool, a plurality of holes formed along the length of said pipe, and a source of water for delivering pressurized water to said spray head and to said pipe, said holes in said pipe being oriented to deliver water into said pool when said pipe receives said pressurized water.

10. The slide of claim 9 wherein there are two sets of said holes for focusing said streams of water upon two specific locations in said pool fore and aft of said hoop.

11. The slide of claim 10 and a curtain of vertical strips hanging from said hoop.

12. The slide of claim 11 and coordinated indicia on at least said curtain for giving a child a fantasy scene.

13. A backyard type of waterslide comprising an elongated strip of plastic having a surface which becomes lubricous when wet, a spray head positioned to maintain a layer of water on the surface of said strip of plastic, a pool attached to and part of said slide along said elongated strip of plastic, a pair of nozzles directed toward separate locations in said pool, the spray of water from said nozzles striking a person sliding along said strip of plastic, and a source of water for delivering pressurized water to said spray head and to said nozzles.

* * * * *